US010777905B2

(12) United States Patent
Diehl et al.

(10) Patent No.: US 10,777,905 B2
(45) Date of Patent: Sep. 15, 2020

(54) LENS WITH CONCENTRIC HEMISPHERICAL REFRACTIVE STRUCTURES

(71) Applicant: THE BOEING COMPANY, Chicago, IL (US)

(72) Inventors: Colin A. M. Diehl, Huntsville, AL (US); Corey M. Thacker, Madison, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/125,436

(22) Filed: Sep. 7, 2018

(65) Prior Publication Data

US 2020/0083612 A1 Mar. 12, 2020

(51) Int. Cl.
*H01Q 19/06* (2006.01)
*H01Q 15/08* (2006.01)

(52) U.S. Cl.
CPC ..... *H01Q 19/062* (2013.01); *H01Q 15/08* (2013.01); *H01Q 19/06* (2013.01)

(58) Field of Classification Search
CPC ..... H01Q 19/06; H01Q 19/062; H01Q 15/08
See application file for complete search history.

(56) References Cited

U.S. PATENT DOCUMENTS 2,677,766 A 5/1954 Litchford
3,404,405 A 10/1968 Young
4,232,321 A 11/1980 Ohm
5,218,322 A 6/1993 Allison et al.
5,421,848 A * 6/1995 Maier ..... H01Q 15/02 264/1.1
7,385,462 B1 6/2008 Epp et al.
9,437,184 B1 9/2016 Swett
9,979,459 B2 5/2018 Savage et al.
10,291,312 B2 5/2019 Savage et al.
(Continued)

FOREIGN PATENT DOCUMENTS

EP 2573872 A1 3/2013
EP 2750246 A1 7/2014
EP 3012916 A1 4/2016
WO 20150102938 7/2015

OTHER PUBLICATIONS

Zhang, S. et al., "3-D-printed flat lens for microwave applications," presented at the Antennas and Propagation Conference (LAPC2015) Loughborough University, 4 pgs.
(Continued)

*Primary Examiner* — Hoang V Nguyen
(74) *Attorney, Agent, or Firm* — Moore IP Law

(57) ABSTRACT

A lens includes a first hemispherical refractive structure having a first effective refractive index based on a first fill pattern of the first hemispherical refractive structure. The lens further includes a second hemispherical refractive structure having a second effective refractive index based on a second fill pattern of the second hemispherical refractive structure. The second hemispherical refractive structure is arranged as a hemispherical shell coupled to and concentric with the first hemispherical refractive structure. The second effective refractive index is different than the first effective refractive index.

20 Claims, 11 Drawing Sheets

(56) References Cited

U.S. PATENT DOCUMENTS

| | | | | |
|---|---|---|---|---|
| 2003/0006941 | A1* | 1/2003 | Ebling | H01Q 3/242 343/911 R |
| 2003/0043086 | A1 | 3/2003 | Schaffner et al. | |
| 2006/0098272 | A1* | 5/2006 | Lerner | C03C 12/02 359/354 |
| 2007/0216596 | A1* | 9/2007 | Lewis | H01Q 1/282 343/848 |
| 2013/0258490 | A1* | 10/2013 | Ishihara | G02B 13/18 359/648 |
| 2016/0322703 | A1 | 11/2016 | Jesme et al. | |
| 2019/0086581 | A1 | 3/2019 | Diehi et al. | |

OTHER PUBLICATIONS

Allen, J. W., et al., "Design and fabrication of an RF GRIN lens 3D printing technology", Proc. of SPiE, vol. 8624, Feb. 20, 2013, 8 pgs.

Delgado, Guillermo et al., "Scanning Properties of Teflon Lenses," Microwave and Optical Technology Letters, vol. 11, No. 5, Apr. 5, 1996, pp. 271-273.

European Patent Office Extended Search Report, Application No. 17175267.8 - 1927, dated Oct. 19, 2017.

Extended European Search Report for Application No. 1818979.5 dated Feb. 18, 2019, 8 pgs.

Jain, Sidharath, et al., "Flat-Base Broadband Multibeam Luneburg Lens for Wide Angle Scan," Cornell University, May 4, 2013, arXiv.org > physics > arXiv:1305.0964.

Schoenlinner, Bernhard, "Compact Wide Scan-Angie Antennas for Automotive Applications and RF MEMS Switchable Frequency-Selective Surfaces," A dissertation submitted in partial fulfillment of the requirements for the degree of Doctor of Philosophy, The University of Michigan, 2004, 72 pgs.

Schoenlinner, Bernhard, "Wide-Scan Spherical-Lens Antennas for Automotive Radars," IEEE Transactions on Microwave theory and Techniquest, vol, 50, No. 9, Sep. 2002, pp. 2166-2175.

Tribe, J. et al, "Additively manufactured hetrogeneous substrates for three-dimensional control of permittivity," Electronics Letters, May 8, 2014, vol. 50, No. 10, pp. 745-746.

* cited by examiner

LENS WITH CONCENTRIC HEMISPHERICAL REFRACTIVE STRUCTURES

FIELD OF THE DISCLOSURE

The present disclosure is generally related to lenses and more particularly to gradient refractive index (GRIN) lenses.

BACKGROUND

Certain electronic devices communicate using electromagnetic (EM) signals. To illustrate, in some systems, data is represented using an EM signal, and the EM signal is provided from an antenna of one electronic device to an antenna of another electronic device via a communication network, such as a wireless network.

In some systems, an EM signal from an antenna is focused using a dish structure (e.g., a parabolic dish) or a lens. In some applications, a dish structure or a lens can be heavy and large, increasing cost of fabrication, installation, or maintenance of the dish structure or lens. In some cases, reducing the size of a dish structure or a lens also reduces the gain of the EM signal, resulting in signal quality degradation, such as by lowering a signal-to-noise ratio (SNR) of the EM signal.

Further, in some cases, less expensive lenses exhibit reduced focusing ability. For example, in some applications, certain ring-based lenses are associated with low focusing ability and are unable to provide a tightly focused, high-gain far-field pattern.

SUMMARY

In a particular example, a lens includes a first hemispherical refractive structure having a first effective refractive index based on a first fill pattern of the first hemispherical refractive structure. The lens further includes a second hemispherical refractive structure having a second effective refractive index based on a second fill pattern of the second hemispherical refractive structure. The second hemispherical refractive structure is arranged as a hemispherical shell coupled to and concentric with the first hemispherical refractive structure. The second effective refractive index is different than the first effective refractive index.

In another example, a method of fabricating a lens includes forming a first hemispherical refractive structure of the lens. The first hemispherical refractive structure has a first effective refractive index based on a first fill pattern of the first hemispherical refractive structure. The method further includes forming a second hemispherical refractive structure of the lens as a hemispherical shell that is coupled to and concentric with the first hemispherical refractive structure. The second hemispherical refractive structure has a second effective refractive index based on a second fill pattern of the second hemispherical refractive structure. The second effective refractive index is different than the first effective refractive index.

In another example, a method of focusing a signal using a lens includes receiving a first signal at the lens. The method further includes focusing the first signal to generate a second signal using a first hemispherical refractive structure of the lens and using a second hemispherical refractive structure of the lens. The first hemispherical refractive structure has a first effective refractive index based on a first fill pattern of the first hemispherical refractive structure. The second hemispherical refractive structure is arranged as a hemispherical shell coupled to and concentric with the first hemispherical refractive structure. The second hemispherical refractive structure has a second effective refractive index based on a second fill pattern of the second hemispherical refractive structure. The second effective refractive index is different than the first effective refractive index.

DETAILED DESCRIPTION

In a particular implementation, a lens includes concentric hemispherical (or spherical) refractive structures. In some examples, the concentric hemispherical refractive structures are manufactured using an additive manufacturing process, such as a three-dimensional (3D) printing process. By using 3D additively manufactured concentric hemispherical structures instead of certain other shapes (e.g., a ring), a gradient refractive index (GRIN) lens having a 3D gradient index profile can be manufactured relatively inexpensively. In some applications, the 3D gradient index profile increases focusing power as compared to a 2D gradient index profile, achieving a tightly focused, high-gain far-field pattern in a compact, lightweight, and easy-to-manufacture package.

In certain implementations, the lens is coupled to an antenna, a waveguide, or a horn, as illustrative examples. In some implementations, the lens is implemented in connection with a compact and lightweight antenna to replace a heavy parabolic dish antenna. Alternatively or in addition, in other examples, the lens is implemented in connection with a low profile, high-gain antenna for mobile platforms, such as cellular telephones. Alternatively or in addition, in other implementations, the lens is implemented in connection with a low-power switched beam antenna as an alternative to a phased array. Alternatively or in addition, in other examples, the lens is used to improve the gain of a horn antenna, a steerable array, or both.

In some examples, the lens is manufactured as a single sphere including each concentric hemispherical or spherical refractive structure (e.g., using a 3D printing process). In other examples, the lens is manufactured as two hemispheres including all concentric hemispheres to be fastened together (e.g., after the 3D printing process). In another example, refractive structures are manufactured separately and assembled (e.g., so that one of the refractive structures is concentric with another one of the refractive structures).

In some circumstances, a 3D printing process produces inaccurate or non-uniform infill ratios. To produce more accurate infill ratios, in some examples, hemispherical refractive structures of the lens each include a linear pattern of thin angled planes with a particular spacing. In some examples, the hemispherical refractive structures are circularly patterned (or "duplicated") at an angle of 120 degrees. In some applications, the resulting pattern (i.e., the linear pattern of thin angled planes circularly patterned at an angle of 120 degrees) is precisely controlled for a desired infill ratio (as compared to other shapes) and is constant across multiple viewing angles.

Figure 1:
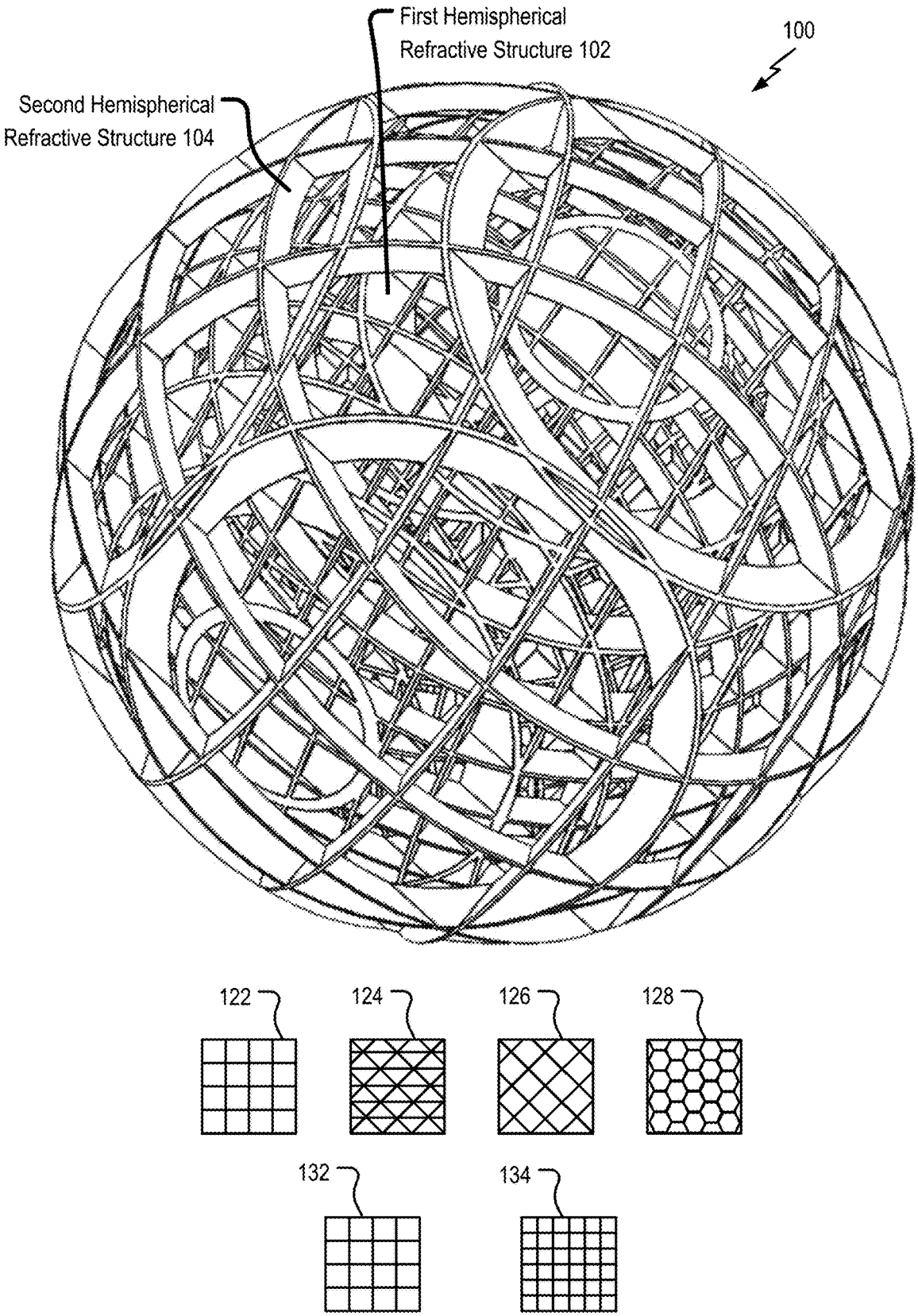
FIG. 1 is a diagram illustrating certain aspects of an example of a lens.

Referring to FIG. 1, a particular illustrative example of a lens is depicted and generally designated 100. The lens 100 is a gradient refractive index (GRIN) lens, such as a Luneburg lens or a fisheye lens, as illustrative examples.

The lens 100 includes multiple refractive structures. For example, in FIG. 1, the lens 100 includes a first hemispherical refractive structure 102 and a second hemispherical refractive structure 104. The second hemispherical refractive structure 104 is arranged as a hemispherical shell coupled to and concentric with the first hemispherical refractive structure 102. To further illustrate, certain illustrative aspects of the first hemispherical refractive structure 102 and the second hemispherical refractive structure 104 are described further below, such as in connection with FIGS. 2A-2D. As an example, in some implementations, the first hemispherical refractive structure 102 and the second hemispherical refractive structure 104 have a concentric hemispherical relationship, as described further with reference to the example of FIG. 2D.

In some implementations, each refractive structure of the lens 100 has a particular fill pattern that determines an effective refractive index of the refractive structure. For example, in some implementations, the first hemispherical refractive structure 102 has a first effective refractive index based on a first fill pattern of the first hemispherical refractive structure 102, and the second hemispherical refractive structure 104 has a second effective refractive index based on a second fill pattern of the second hemispherical refractive structure 104, where the second fill pattern is different from the first fill pattern. To further illustrate, in some examples, the first fill pattern includes one of a linear fill pattern 122, a triangular fill pattern 124, a diagonal fill pattern 126, or a hexagonal fill pattern 128, and the second fill pattern includes another of the linear fill pattern 122, the triangular fill pattern 124, the diagonal fill pattern 126, or the hexagonal fill pattern 128. It should be appreciated that the particular fill patterns are illustrative and that other fill patterns can be used in other implementations.

In a particular example, the second effective refractive index is different than (e.g., less than) the first effective refractive index (e.g., to facilitate a gradient refractive index of the lens 100). In one example, the first effective refractive index and the second effective refractive index define a gradient refractive index of a Luneburg lens. In another example, the first effective refractive index and the second effective refractive index define a gradient refractive index of a fisheye lens. In other examples, different effective refractive indices are selected in order to facilitate a different refractive index of the lens 100.

Alternatively or in addition to use of a fill pattern to determine an effective refractive index of a refractive structure, in some implementations, a fill density is selected to determine an effective refractive index of a refractive structure. In one example, the first hemispherical refractive structure 102 has a first fill density 132, and the second hemispherical refractive structure 104 has a second fill density 134 different than the first fill density. In the example of FIG. 1, the fill densities 132, 134 share a common fill pattern (the linear fill pattern 122). In other examples, the fill densities can be varied in connection with different fill patterns.

Alternatively or in addition, in some implementations, a type of material is used to determine an effective refractive index of a refractive structure. For example, in some implementations, the first hemispherical refractive structure 102 includes a first material (e.g., a first filament), and the second hemispherical refractive structure 104 includes a second material (e.g., a second filament) that is different than the first material. In some examples, the first material and the second material correspond to different 3D printer filament materials used by a 3D printer in connection with a 3D printing process.

In one example, fill densities of hemispherical refractive structure of the lens 100 are varied (e.g., as function of radius from the center of the lens 100) to achieve an effective permittivity equal to the target effective permittivity of the lens 100. In some implementations, a weighted average is used to determine the fill density for the target effective permittivity. For example, in some implementations, a fill density f of the lens 100 is determined based on $$f = \frac{\varepsilon_{eff} - 1}{\varepsilon_0 - 1},$$

where $\varepsilon_{eff}$ indicates the target permittivity, and where $\varepsilon_0$ indicates permittivity of the material of the lens 100.

To further illustrate, in some examples, the lens 100 is fabricated using an additive manufacturing process (e.g., a three-dimensional (3D) printing process) that uses, for each refractive structure of the lens 100, a selectable fill pattern, a selectable fill density, one or more other selectable parameters, or a combination thereof. Alternatively or in addition, in some examples, the lens 100 is fabricated using a subtractive computerized manufacturing process, such as a milling process, as an illustrative example. In some examples, the lens 100 is fabricated using a combination of one or more additive computerized manufacturing processes and one or more subtractive computerized manufacturing processes, such as a combined photolithographic and etching process, as an illustrative example.

In some examples, each hemispherical refractive structure of the lens 100 has a thickness that is based on a wavelength (or frequency) of signals to be focused by the lens. In one example, each hemispherical refractive structure of the lens 100 has a thickness that is less than the wavelength of signals to be focused by the lens 100.

One or more aspects of FIG. 1 enable accurate focusing of signals using a relatively inexpensive lens design. For example, by using concentric hemispherical structures rather than certain other shapes (e.g., a ring), the lens 100 has a 3D gradient index profile instead of a two-dimensional (2D) gradient index profile and can be manufactured relatively inexpensively using an additive manufacturing process. In some applications, the 3D gradient index profile increases focusing power as compared to a 2D gradient index profile, achieving a tightly focused, high-gain far-field pattern in a compact, lightweight, and easy-to-manufacture package.

Figure 2A:
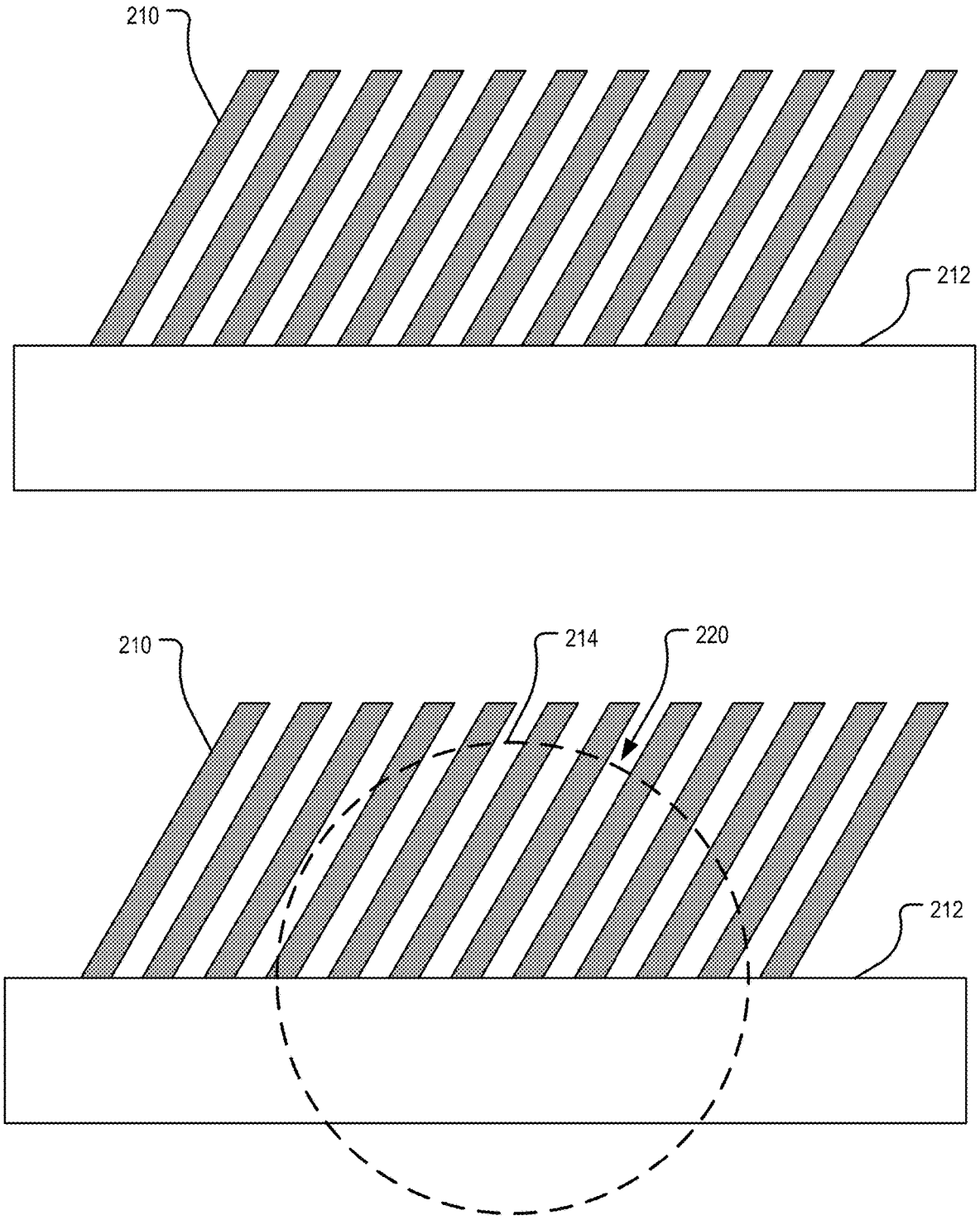
FIG. 2A is a diagram illustrating certain aspects associated with an example of the lens of FIG. 1.
Figure 2B:
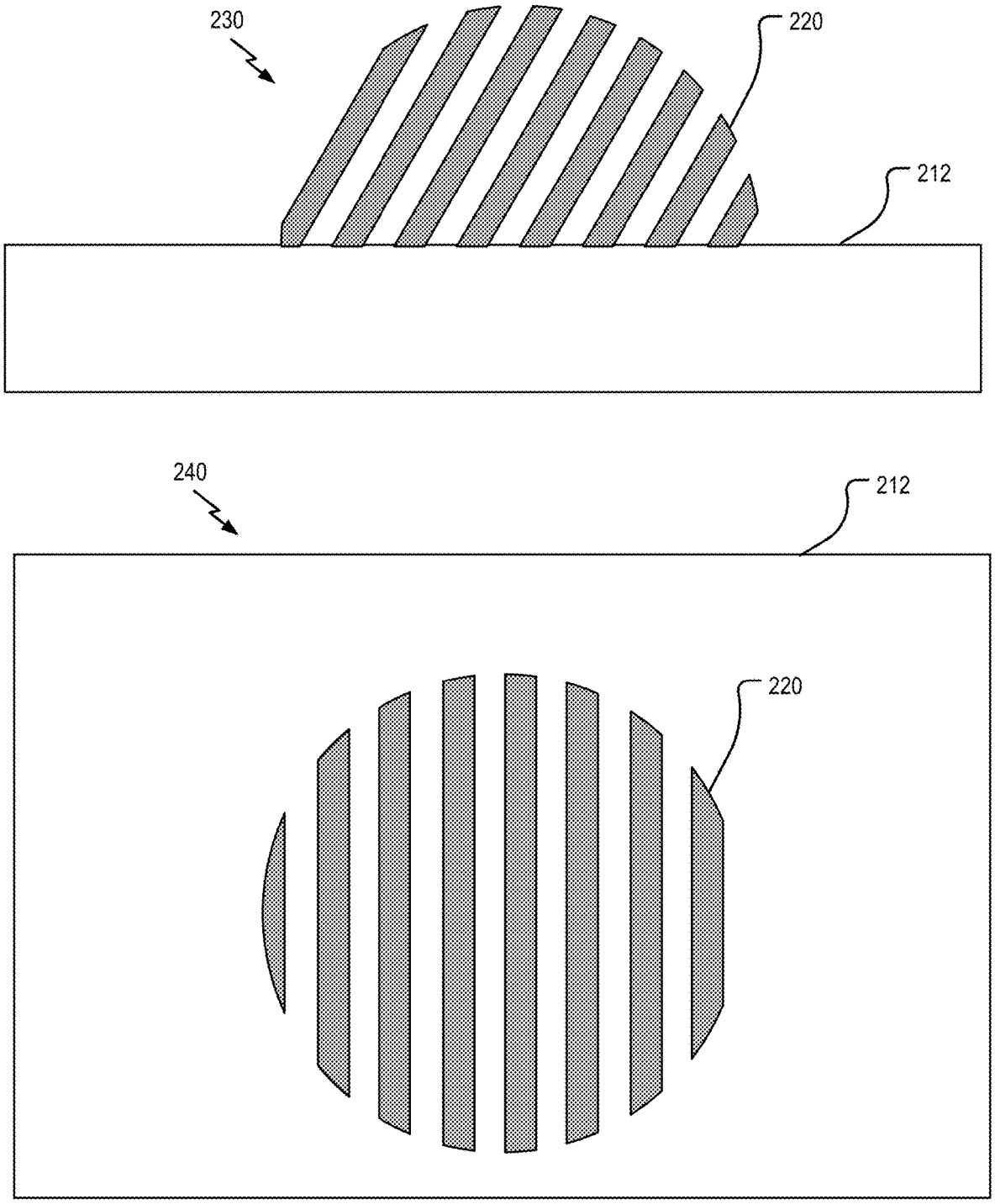
FIG. 2B is a diagram illustrating additional aspects associated with an example of the lens of FIG. 1.
Figure 2C:
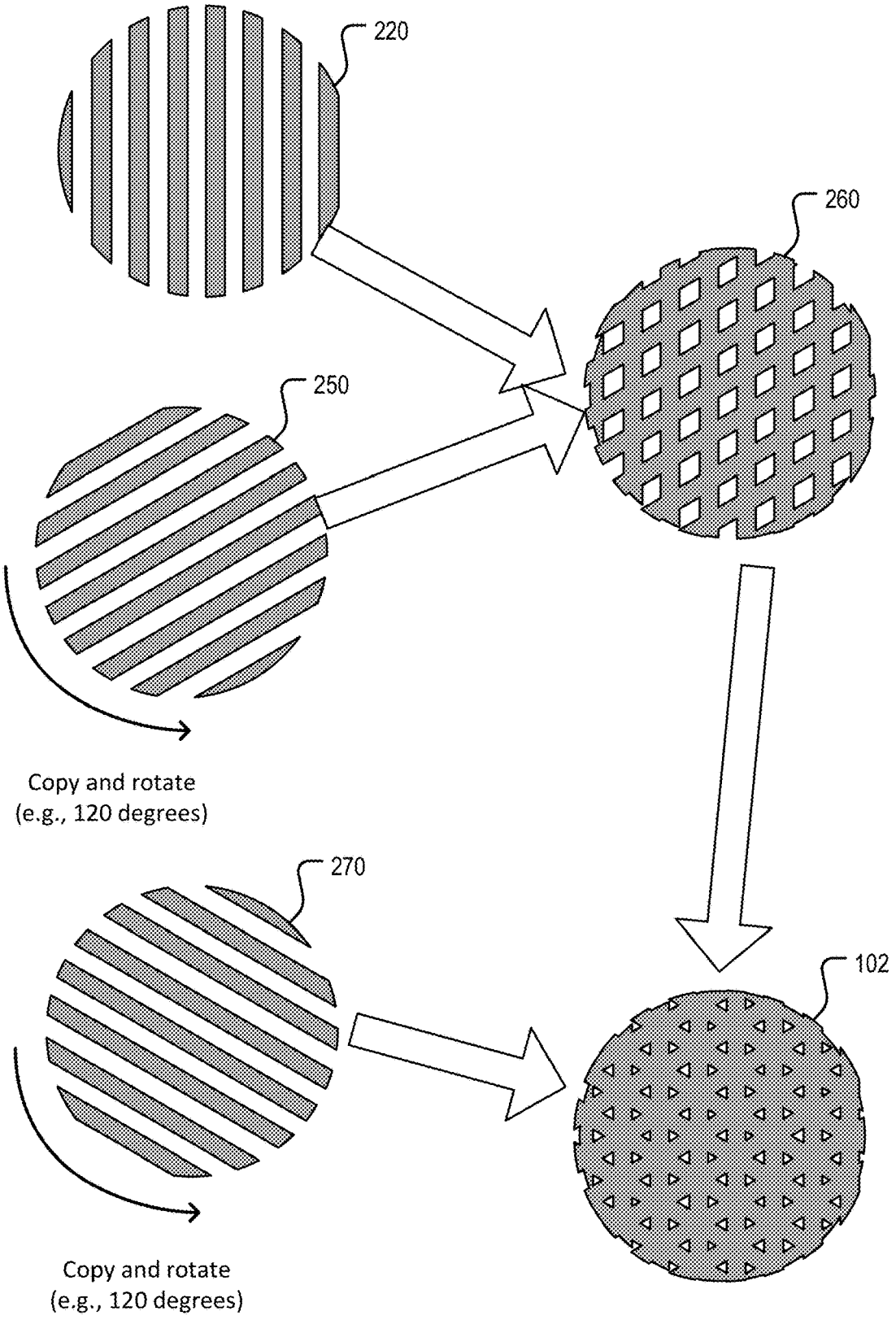
FIG. 2C is a diagram illustrating additional aspects associated with an example of the lens of FIG. 1.

FIGS. 2A-2D illustrate aspects of a hemispherical refractive structure, such as the first hemispherical refractive structure 102, the second hemispherical refractive structure 104, or both. It is noted that FIGS. 2A, 2B, and 2C are provided to facilitate conceptualization of a hemispherical refractive structure and that a hemispherical refractive structure need not be physically fabricated in accordance with FIGS. 2A, 2B, and 2C. To illustrate, in some examples, the aspects of FIGS. 2A-2D are used to generate a design of the lens 100, and the design is used to generate instructions executable by a processor to cause a 3D printer to fabricate the lens.

FIG. 2A illustrates a side view of a first plurality of plate structures 210 extending at an angle from a substrate 212. In FIG. 2A, the first plurality of plate structures 210 extend in a direction into or out of the page. In FIG. 2A, a first spherical cut line 214 is shown. The first spherical cut line 214 encloses a hemispherical region to define a portion 220 of the first plurality of plate structures 210 (e.g., so that portions outside of the first spherical cut line 214 are disregarded).

FIG. 2B depicts a side view of the portion 220 with portions of the first plurality of plate structures 210 that are outside the first spherical cut line 214 omitted, at 230. FIG. 2B also depicts a top down view of the portion 220, at 240.

In FIG. 2C, the portion 220 is copied and rotated (e.g., by 120 degrees) to generate a second portion 250. A union of the portions 220, 250 is performed to generate a plurality of intersecting plate structures 260. FIG. 2C also shows that the second portion 250 is copied and rotated (e.g., by 120 degrees) to generate a third portion 270. A union of the third portion 270 and the plurality of intersecting plate structures 260 is performed to generate a hemispherical refractive structure, such as the first hemispherical refractive structure 102, as an illustrative example.

In some implementations, one or more aspects of a plurality of plate structures are selected in order to determine an effective refractive index associated with a hemispherical refractive structure. To illustrate, in some examples, one or more of a number of plate structures, a spacing between the plate structures, or a thickness of the plate structures are varied in order to determine an effective refractive index.

Figure 2D:
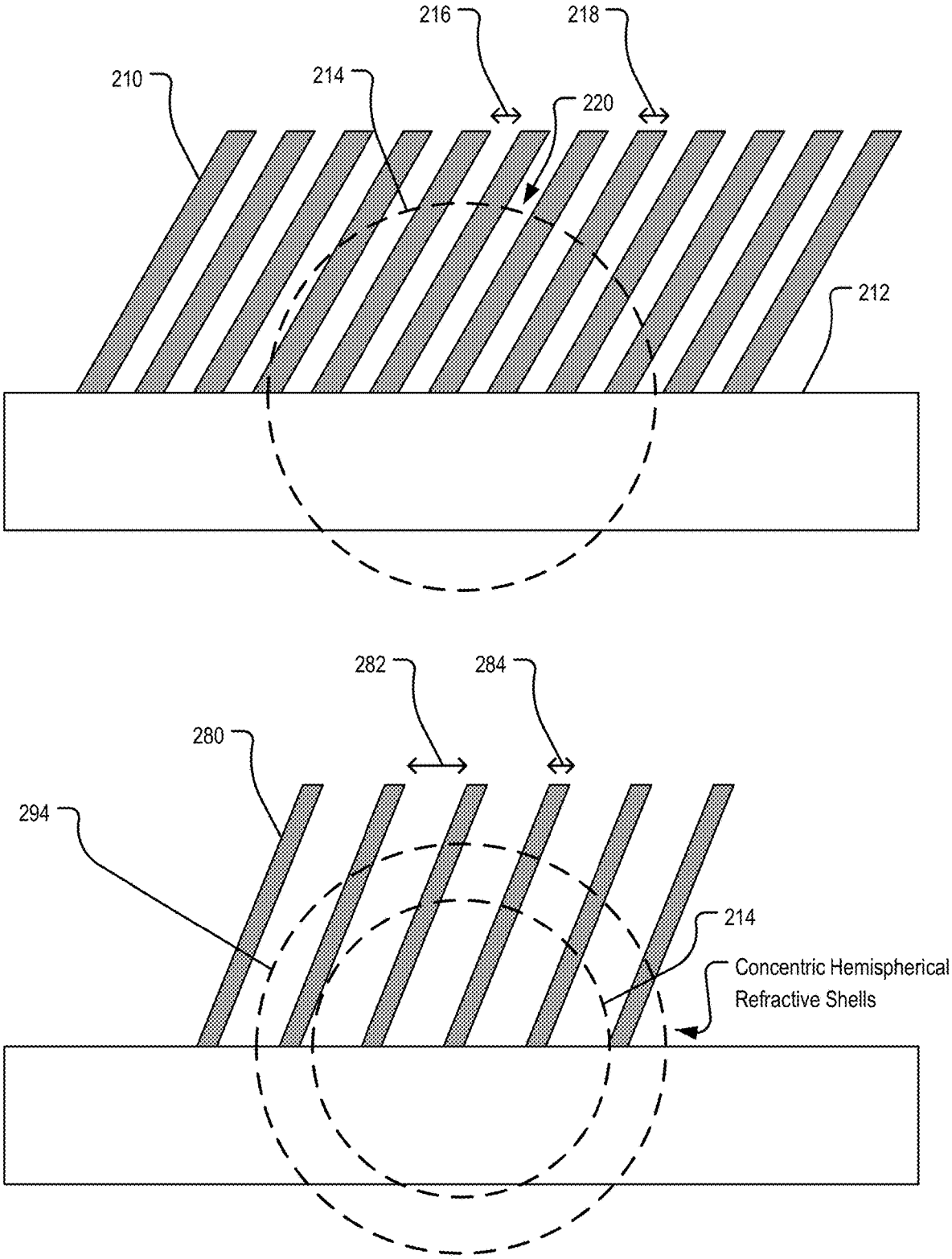
FIG. 2D is a diagram illustrating additional aspects associated with an example of the lens of FIG. 1.

To illustrate, FIG. 2D depicts examples of the first plurality of plate structures 210 and a second plurality of plate structures 280. In a particular example, the first hemispherical refractive structure 102 includes the first plurality of plate structures 210 (or a portion of the first plurality of plate structures, such as the portion 220), and the second hemispherical refractive structure 104 includes the second plurality of plate structures 280 (or a portion thereof).

In FIG. 2D, the second plurality of plate structures 280 is associated with the first spherical cut line 214 and a second spherical cut line 294. In some implementations, the first spherical cut line 214 defines a radius of the first hemispherical refractive structure 102, and the second spherical cut line 294 defines a radius of the second hemispherical refractive structure 104. To illustrate, in some implementations, a first radius of the first spherical cut line 214 corresponds to the radius of the first hemispherical refractive structure 102, and a second radius of the second spherical cut line 294 corresponds to the radius of the second hemispherical refractive structure 104 (within certain manufacturing tolerances that may be associated with the particular fabrication process). A difference between the first spherical cut line 214 and the second spherical cut line 294 corresponds to a shell thickness of the second hemispherical refractive structure 104.

In the example of FIG. 2D, the spherical cut lines 214, 294 define concentric hemispherical structures. To illustrate, in a particular example, the first hemispherical refractive structure 102 is formed from the first plurality of plate structures 210 based on the first spherical cut line 214, and the second hemispherical refractive structure 104 is formed from the second plurality of plate structures 280 based on the first spherical cut line 214 and the second spherical cut line 294.

In one example, a first effective refractive index of the first hemispherical refractive structure 102 is based on a first spacing 216 between plate structures of the first plurality of plate structures 210, and a second effective refractive index of the second hemispherical refractive structure 104 is based on a second spacing 282 between plate structures of the second plurality of plate structures 280, where the second spacing 282 is different than the first spacing 216. In the particular example of FIG. 2D, the second spacing 282 is greater than the first spacing 216.

Alternatively or in addition, in some implementations, the first effective refractive index is based on a first number of plate structures of the first plurality of plate structures 210, and the second effective refractive index is based on a second number of plate structures of the second plurality of plate structures 280, where the second number is different than the first number. To illustrate, in the example of FIG. 2D, the second number of plate structures is less than the first number of plate structures.

Alternatively or in addition, in some implementations, the first effective refractive index is based on a first plate structure thickness 218 of the first plurality of plate structures 210, and the second effective refractive index is based on a second plate structure thickness 284 of the second plurality of plate structures 280, where the second plate structure thickness 284 is different than the first plate structure thickness 218. To illustrate, in the example of FIG. 2D, the second plate structure thickness 284 is less than the first plate structure thickness 218.

Alternatively or in addition, in some implementations, the first effective refractive index is based on the first radius of the first spherical cut line 214, and the second effective refractive index is based on the second radius of the second spherical cut line 294, where the second radius is different than the first radius. To illustrate, in the example of FIG. 2D, the second radius is greater than the first radius.

One or more aspects of FIGS. 2A-2D enable accurate focusing of signals using a relatively inexpensive lens design. For example, by using concentric hemispherical structures rather than certain other shapes (e.g., a ring), the lens 100 has a 3D gradient index profile instead of a two-dimensional (2D) gradient index profile and can be manufactured relatively inexpensively using an additive manufacturing process. In some applications, the 3D gradient index profile increases focusing power as compared to a 2D gradient index profile, achieving a tightly focused, high-gain far-field pattern in a compact, lightweight, and easy-to-manufacture package.

Figure 3:
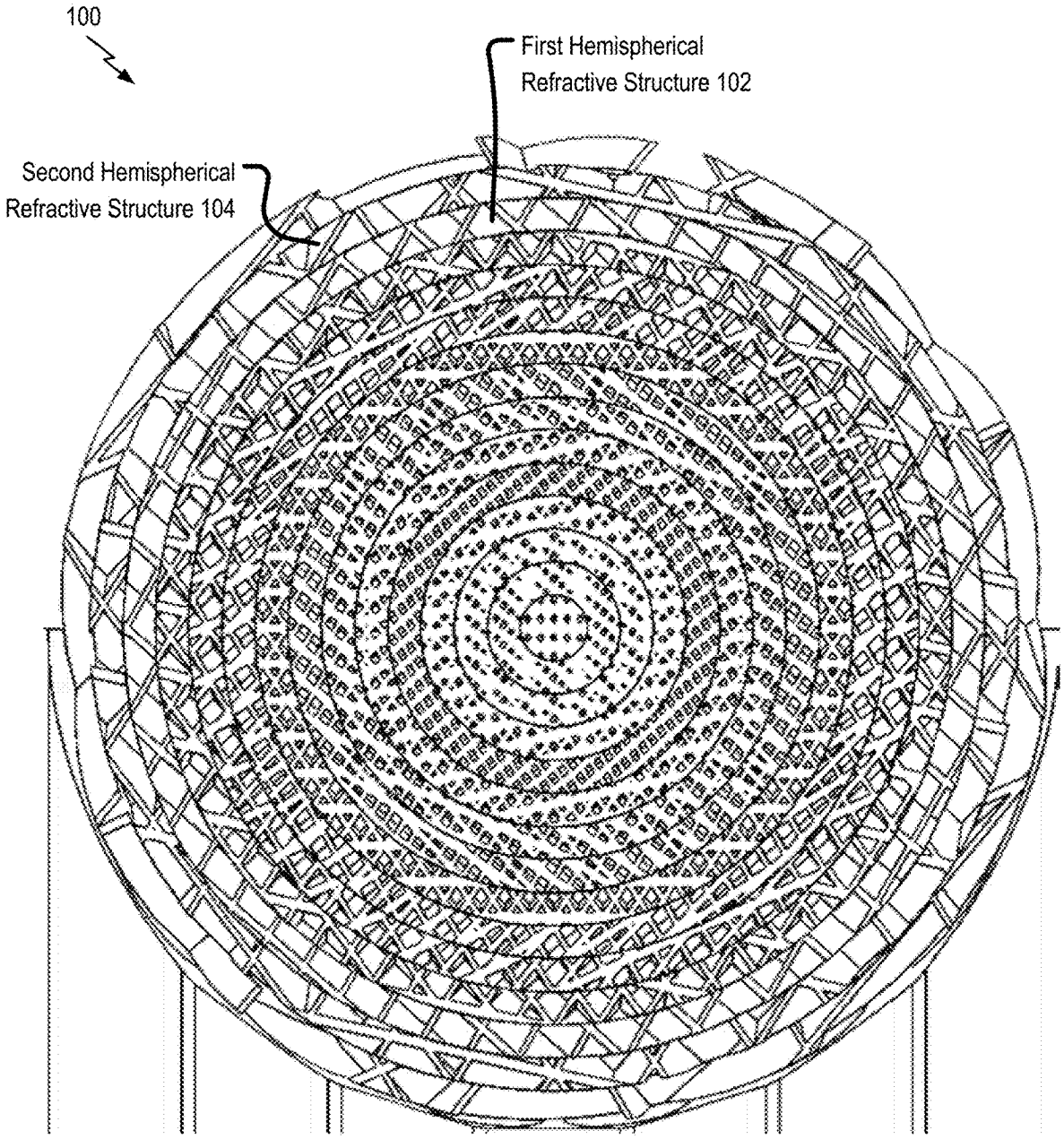
FIG. 3 is a diagram of a cross-sectional view of an example of the lens of FIG. 1.

FIG. 3 illustrates a cross-sectional view of the lens 100. In the example of FIG. 3, the first hemispherical refractive structure 102 is associated with a different fill density as compared to the second hemispherical refractive structure 104. In FIG. 3, the first hemispherical refractive structure 102 has a first fill density that is greater than a second fill density of the second hemispherical refractive structure 104.

In some examples, the lens 100 has a fill density "profile" that varies with radial distance from the center of the lens 100. To illustrate, in some examples, fill density of the lens 100 varies according to a linear function of the radial distance from the center of the lens 100, a quadratic function of the radial distance from the center of the lens 100, a cubic function of the radial distance from the center of the lens 100, a polynomial function of the radial distance from the center of the lens 100, a spline function of the radial distance from the center of the lens 100, an exponential function of the radial distance from the center of the lens 100, a logarithmic function of the radial distance from the center of the lens 100, or another function, as illustrative examples. In some applications, a particular fill density profile of the lens 100 is selected to achieve a particular gradient refractive index of the lens 100 (e.g., to achieve either a Luneburg lens gradient refractive index or a fisheye lens gradient refractive index, as illustrative examples).

One or more aspects of FIG. 3 enable accurate focusing of signals using a relatively inexpensive lens. For example, by using concentric hemispherical structures rather than certain other shapes (e.g., a ring), the lens 100 has a 3D gradient index profile instead of a two-dimensional (2D) gradient index profile and can be manufactured relatively inexpensively using an additive manufacturing process. In some applications, the 3D gradient index profile increases focusing power as compared to a 2D gradient index profile, achieving a tightly focused, high-gain far-field pattern in a compact, lightweight, and easy-to-manufacture package.

Figure 4:
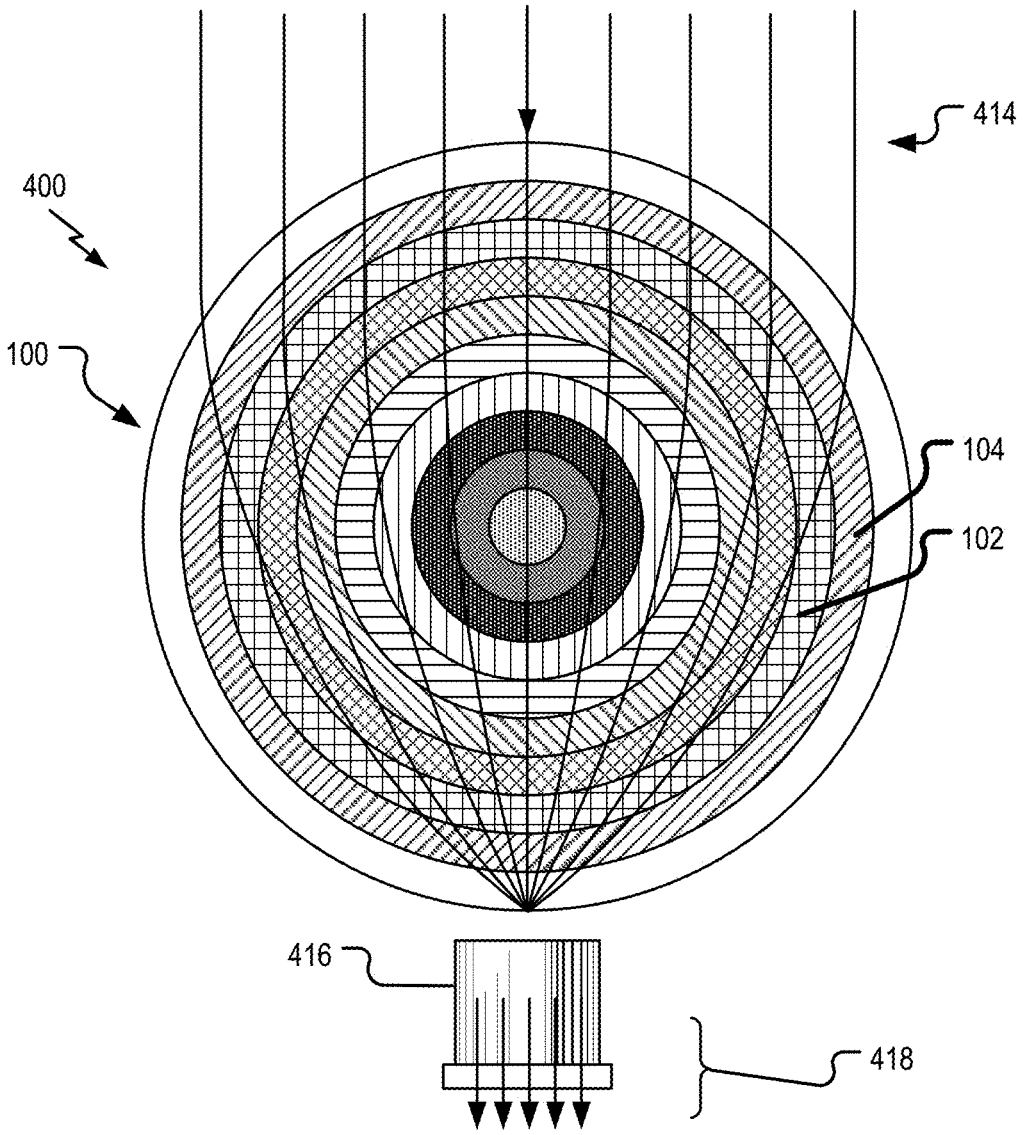
FIG. 4 is a diagram of an example of a system that includes the lens of FIG. 1.

FIG. 4 illustrates an example of a system 400 that includes the lens 100. In some implementations, the lens 100 is configured to focus an electromagnetic (EM) signal received from a waveguide, to focus an EM signal to be provided to a waveguide, or a combination thereof. To illustrate, in the example of FIG. 4, the lens 100 is coupled to an antenna or a waveguide, such as a waveguide 416. In the example of FIG. 4, the lens 100 corresponds to a Luneburg lens.

In one example, the lens 100 is configured to receive a first signal 414 from a source. In some examples, the lens 100 is configured to focus the first signal 414 to generate a second signal 418 (e.g., a collimated version of the first signal 414). In a particular example, the lens 100 is configured to focus the first signal 414 by refracting at least a first portion of the first signal 414 using the first hemispherical refractive structure 102 and by refracting at least a second portion of the first signal 414 using the second hemispherical refractive structure 104. In some implementations, the lens 100 is configured to output the second signal 418 to the waveguide 416.

Figure 5:
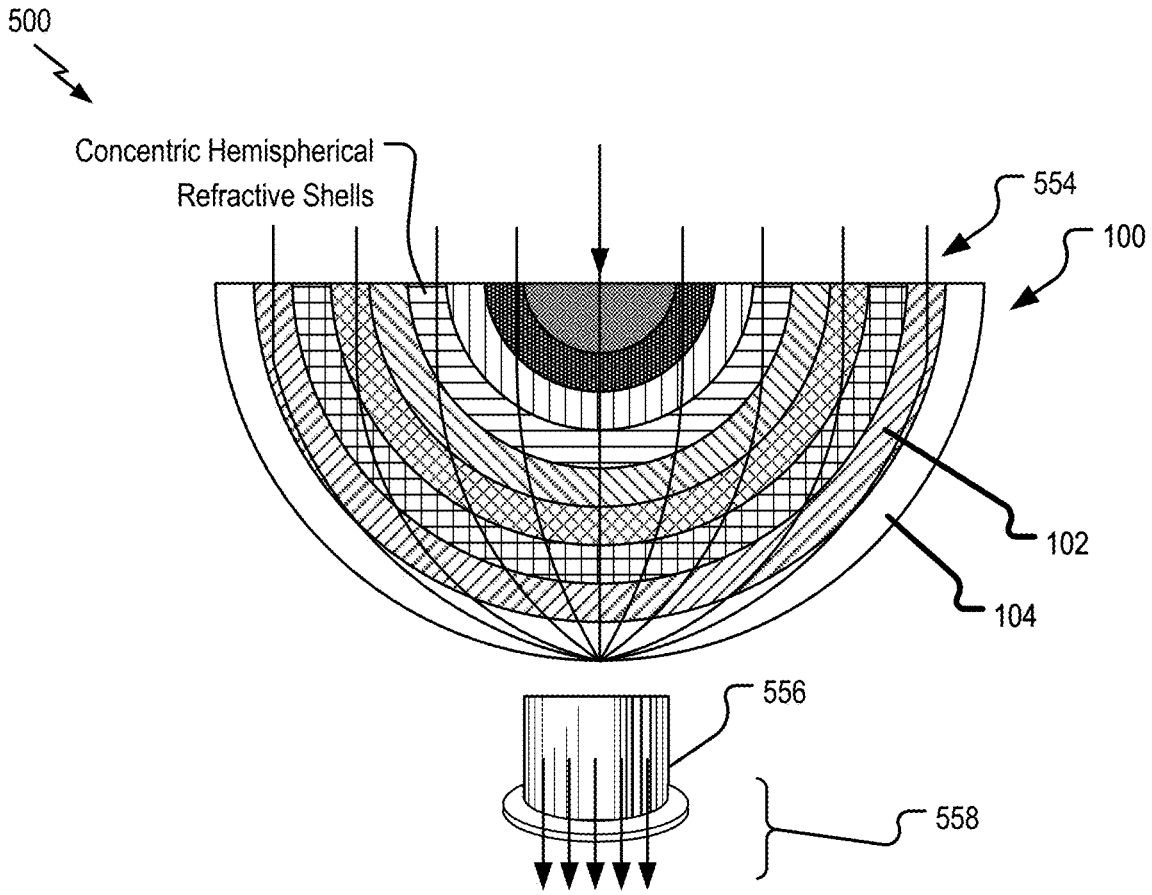
FIG. 5 is a diagram of another example of a system that includes the lens of FIG. 1.

FIG. 5 illustrates another example of a system 500 that includes the lens 100. To illustrate, in the example of FIG. 5, the system 500 includes the lens 100, and the lens 100 is coupled to a waveguide or an antenna, such as a radio antenna 556. In the example of FIG. 5, the lens 100 corresponds to a fisheye lens.

In a particular example, the lens 100 is configured to receive a first signal 554 from a source. In some examples, the lens 100 is configured to focus the first signal 554 to generate a second signal 558 (e.g., a collimated version of the first signal 554). In a particular example, the lens 100 is configured to focus the first signal 554 by refracting at least a first portion of the first signal 554 using the first hemispherical refractive structure 102 and by refracting at least a second portion of the first signal 554 using the second hemispherical refractive structure 104. In some implementations, the lens 100 is configured to output the second signal 558 to the radio antenna 556.

It should be appreciated that the examples of FIGS. 4 and 5 are provided for illustration and that other examples are within the scope of the disclosure. For example, although FIG. 4 depicts a Luneburg lens implementation of the lens 100 in connection with a waveguide, in other examples, the lens 100 corresponds to a fisheye lens that is coupled to a waveguide (e.g., the waveguide 416). As another example, although FIG. 5 depicts a fisheye lens implementation of the lens 100 in connection with a radio antenna, in other examples, the lens 100 corresponds to a Luneburg lens that is coupled to a radio antenna (e.g., the radio antenna 556).

One or more aspects of FIGS. 4 and 5 reduce cost or complexity associated with signal reception, signal transmission, or both. For example, in some implementations, the lens 100 is implemented in connection with a compact and lightweight antenna to replace a heavy parabolic dish antenna. Alternatively or in addition, in other examples, the lens 100 is implemented in connection with a low profile, high-gain antenna for mobile platforms, such as cellular telephones. Alternatively or in addition, in other implementations, the lens 100 is implemented in connection with a low-power switched beam antenna as an alternatively to a phased array. Alternatively or in addition, in other examples, the lens 100 is used to improve the gain of a horn antenna, is used in connection with a steerable array, or both.

Figure 6:
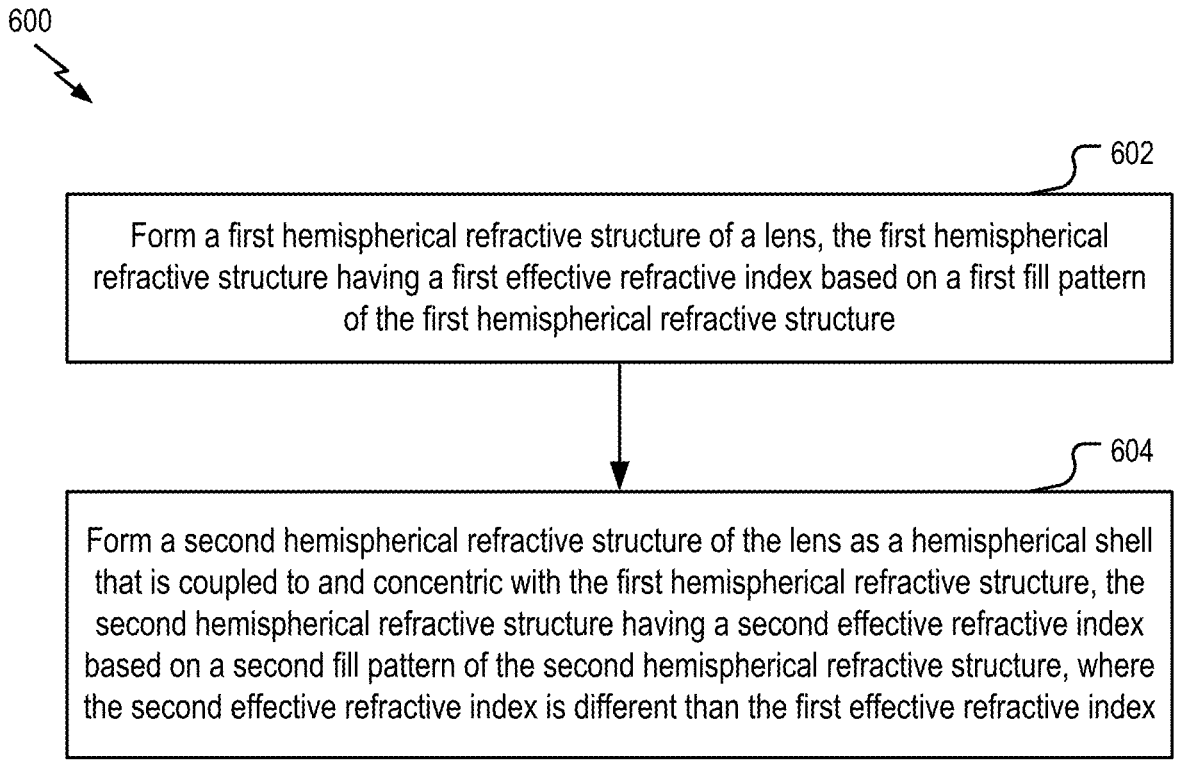
FIG. 6 is a flow chart of an example of a method of fabricating the lens of FIG. 1.

Referring to FIG. 6, an illustrative example of a method of fabricating a lens is depicted and generally designated 600. In some examples, the method 600 is performed to fabricate the lens 100 (e.g., a Luneburg lens or a fisheye lens, as illustrative examples).

The method 600 includes forming a first hemispherical refractive structure (e.g., the first hemispherical refractive structure 102) of a lens (e.g., the lens 100), at 602. The first hemispherical refractive structure has a first effective refractive index based on a first fill pattern of the first hemispherical refractive structure.

The method 600 further includes forming a second hemispherical refractive structure (e.g., the second hemispherical refractive structure 104) of the lens as a hemispherical shell that is coupled to and concentric with the first hemispherical refractive structure, at 604. The second hemispherical refractive structure has a second effective refractive index based on a second fill pattern of the second hemispherical refractive structure, and the second effective refractive index is different than (e.g., less than) the first effective refractive index. In a particular example, the first hemispherical refractive structure and the second hemispherical refractive structure are formed using an additive manufacturing process.

In some examples, forming the first hemispherical refractive structure includes forming a first plurality of plate structures (e.g., the first plurality of plate structures 210) dimensioned to provide the first effective refractive index, and forming the second hemispherical refractive structure includes forming on the first hemispherical refractive structure a second plurality of plate structures (e.g., the second plurality of plate structures 280) dimensioned to provide the second effective refractive index. To illustrate, in some examples, the first plurality of plate structures are dimensioned based on the first plate structure thickness 218 of FIG. 2D, and the second plurality of plate structures are dimensioned based on the second plate structure thickness 284 of FIG. 2D.

Alternatively or in addition, in some examples, forming the first hemispherical refractive structure includes forming a first plurality of plate structures (e.g., the first plurality of plate structures 210) having a first spacing (e.g., the first spacing 216) to provide the first effective refractive index.

Further, in some examples, forming the second hemispherical refractive structure includes forming on the first hemispherical refractive structure a second plurality of plate structures (e.g., the second plurality of plate structures 280) having a second spacing (e.g., the second spacing 282) to provide the second effective refractive index.

Alternatively or in addition, in some examples, forming the first hemispherical refractive structure includes forming a first plurality of plate structures (e.g., the first plurality of plate structures 210) having the first fill pattern to provide the first effective refractive index, and forming the second hemispherical refractive structure includes forming on the first hemispherical refractive structure a second plurality of plate structures (e.g., the second plurality of plate structures 280) having the second fill pattern to provide the second effective refractive index. In a non-limiting illustrative example, the first fill pattern includes one of the linear fill pattern 122, the triangular fill pattern 124, the diagonal fill pattern 126, or the hexagonal fill pattern 128, and the second fill pattern includes another of the linear fill pattern 122, the triangular fill pattern 124, the diagonal fill pattern 126, or the hexagonal fill pattern 128.

Alternatively or in addition, in some examples, forming the first hemispherical refractive structure includes forming a first plurality of plate structures (e.g., the first plurality of plate structures 210) having a first fill density (e.g., the first fill density 132) to provide the first effective refractive index, and forming the second hemispherical refractive structure includes forming on the first hemispherical refractive structure a second plurality of plate structures (e.g., the second plurality of plate structures 280) having a second fill density (e.g., the second fill density 134) to provide the second effective refractive index.

In some implementations, the method 600 further includes attaching a first bisectional portion to a second bisectional portion to form the lens 100. For example, after fabricating a first bisectional portion as depicted in the example of FIG. 5, a second bisectional portion can be attached (e.g., bonded) to the first bisectional portion to form a spherical lens (e.g., to form a Luneburg lens corresponding to the lens 100). Alternatively, in other implementations, the lens 100 includes a single bisectional portion, such as in a fisheye lens implementation, as an illustrative example.

One or more aspects of FIG. 6 enable inexpensive fabrication of certain lenses. For example, by using concentric hemispherical structures rather than certain other shapes (e.g., a ring), the lens 100 has a 3D gradient index profile instead of a two-dimensional (2D) gradient index profile and can be manufactured relatively inexpensively using an additive manufacturing process. In some applications, the 3D gradient index profile increases focusing power as compared to a 2D gradient index profile, achieving a tightly focused, high-gain far-field pattern in a compact, lightweight, and easy-to-manufacture package.

Figure 7:
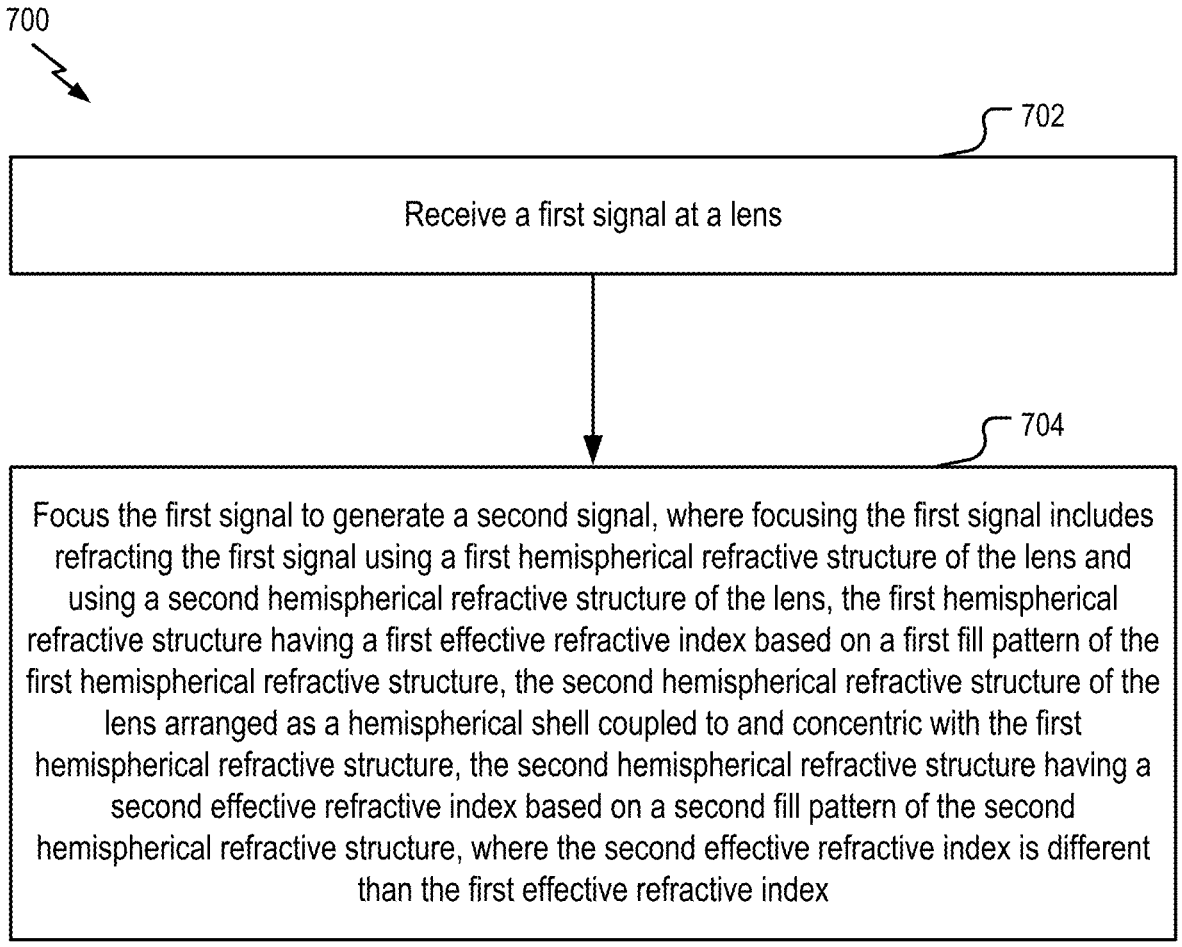
FIG. 7 is a flow chart of an example of a method of focusing a signal using the lens of FIG. 1.

Referring to FIG. 7, a method of focusing a signal using a lens is depicted and generally designated 700. In a particular example, the method 700 is performed to operate the lens 100 (e.g., a Luneburg lens or a fisheye lens, as illustrative examples).

The method 700 includes receiving a first signal at a lens, at 702. To illustrate, in some implementations, the lens 100 receives the first signal 414. In another example, the lens 100 receives the first signal 554.

The method 700 further includes focusing the first signal to generate a second signal, at 704. The first signal is focused using a first hemispherical refractive structure (e.g., the first hemispherical refractive structure 102) of the lens and using a second hemispherical refractive structure (e.g., the second hemispherical refractive structure 104) of the lens. The first hemispherical refractive structure has a first effective refractive index based on a first fill pattern of the first hemispherical refractive structure. The second hemispherical refractive structure is arranged as a hemispherical shell coupled to and concentric with the first hemispherical refractive structure. The second hemispherical refractive structure has a second effective refractive index based on a second fill pattern of the second hemispherical refractive structure, and the second effective refractive index is different than (e.g., less than) the first effective refractive index.

In one example, the method 700 further includes outputting the second signal to a waveguide. To illustrate, in some implementations, the lens 100 outputs the second signal 418 to the waveguide 416. In another example, the method 700 further includes outputting the second signal to radio antenna. To illustrate, in some implementations, the lens 100 outputs the second signal 558 to the radio antenna 556. In other implementations, the second signal is output to free space.

One or more aspects of FIG. 7 enable enhanced focusing of signals. For example, by using concentric hemispherical structures rather than certain other shapes (e.g., a ring), the lens 100 has a 3D gradient index profile instead of a two-dimensional (2D) gradient index profile. In some applications, the 3D gradient index profile increases focusing power as compared to a 2D gradient index profile, achieving a tightly focused, high-gain far-field pattern in a compact, lightweight, and easy-to-manufacture package.

Figure 8:
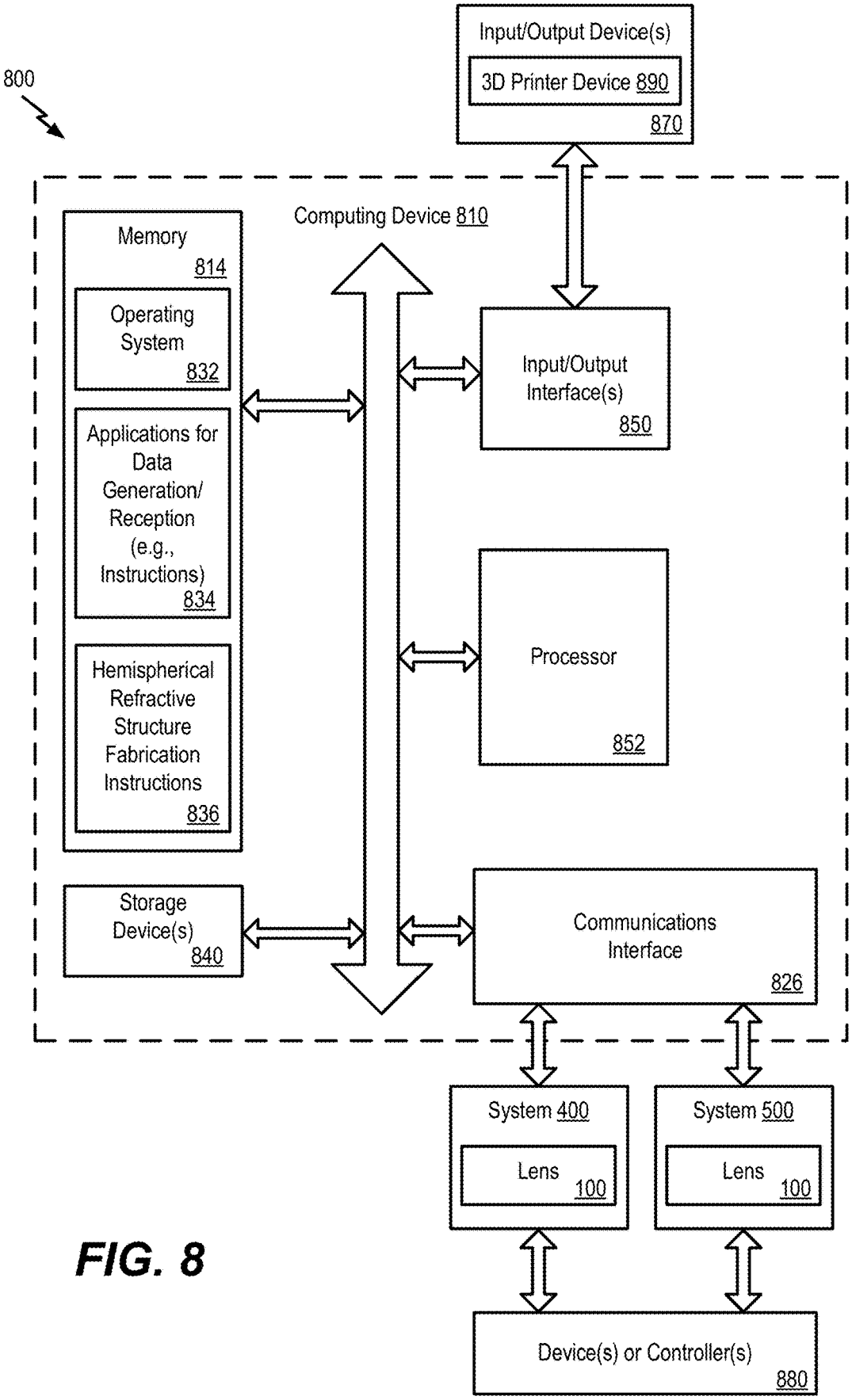
FIG. 8 is a block diagram illustrating aspects of an example of a computing system that is configured to execute instructions to initiate or control operations of the method of FIG. 6, or that is configured to focus a signal by initiating or controlling operations of the method of FIG. 7, or both.

FIG. 8 is an illustration of a block diagram of a computing environment 800 including a computing device 810 (e.g., a general-purpose computing device) configured to support embodiments of computer-implemented methods and computer-executable program instructions (or code) according to the present disclosure. In some examples, the computing device 810, or portions thereof, execute instructions to initiate, perform, or control operations described herein.

The computing device 810 includes a processor 852. The processor 852 is configured to communicate with a memory 814 (e.g., a system memory), one or more storage devices 840, one or more input/output interfaces 850, a communications interface 826, or a combination thereof.

Depending on the particular implementation, the memory 814 includes volatile memory devices (e.g., random access memory (RAM) devices), nonvolatile memory devices (e.g., read-only memory (ROM) devices, programmable read-only memory, or flash memory), one or more other memory devices, or a combination thereof. In FIG. 8, the memory 814 stores an operating system 832, which can include a basic input/output system for booting the computing device 810 as well as a full operating system to enable the computing device 810 to interact with users, other programs, and other devices. The particular example of FIG. 8 also depicts that the memory 814 stores one or more applications 834 executable by the processor 852. In some examples, the one or more applications 834 include instructions executable by the processor 852 to transmit signals between components of the computing device 810, such as the memory 814, the one or more storage devices 840, the one or more input/output interfaces 850, the communications interface 826, or a combination thereof.

In certain implementations, the memory 814 further stores hemispherical refractive structure fabrication instructions 836 executable by the processor 852 to initiate or control operations of the method 600 of FIG. 6. To illustrate, in some implementations, the computing device 810 includes or is in communication with a manufacturing device, such as a three-dimensional (3D) printer device 890. In some examples, the hemispherical refractive structure fabrication instructions 836 are executable by the processor 852 to cause the 3D printer device 890 to fabricate the lens 100.

In some implementations, one or more storage devices 840 include nonvolatile storage devices, such as magnetic disks, optical disks, or flash memory devices. In some examples, the one or more storage devices 840 include removable memory devices, non-removable memory devices or both. In some cases, the one or more storage devices 840 are configured to store an operating system, images of operating systems, applications, and program data. In a particular example, the memory 814, the one or more storage devices 840, or both, include tangible computer-readable media.

In the example of FIG. 8, the processor 852 is configured to communicate with the one or more input/output interfaces 850 to enable the computing device 810 to communicate with one or more input/output devices 870 to facilitate user interaction. In some implementations, the one or more input/output interfaces 850 include serial interfaces (e.g., universal serial bus (USB) interfaces or Institute of Electrical and Electronics Engineers (IEEE) 1394 interfaces), parallel interfaces, display adapters, audio adapters, one or more other interfaces, or a combination thereof. In some examples, the one or more input/output devices 870 include keyboards, pointing devices, displays, speakers, microphones, touch screens, one or more other devices, or a combination thereof. In some examples, the processor 852 is configured to detect interaction events based on user input received via the one or more input/output interfaces 850. Additionally, in some implementations, the processor 852 is configured to send a display to a display device via the one or more input/output interfaces 850. In some implementations, the one or more input/output devices 870 include the 3D printer device 890.

In a particular example, the processor 852 is configured to communicate with (or send signals to) one or more devices 880 using the communications interface 826. In some implementations, the communications interface 826 includes one or more wired interfaces (e.g., Ethernet interfaces), one or more wireless interfaces that comply with an IEEE 802.11 communication protocol, one or more other wireless interfaces, one or more optical interfaces, or one or more other network interfaces, or a combination thereof. In some examples, the one or more devices 880 include host computers, servers, workstations, one or more other computing devices, or a combination thereof.

In some implementations, the computing device 810 is configured to communicate with the one or more devices 880 using the system 400. To illustrate, in some examples, the communications interface 826 includes an EM interface configured to communicate with the one or more devices 880 using an EM network that includes the system 400. Alternatively or in addition, in some implementations, the computing device 810 is configured to communicate with the one or more devices 880 using the system 500. To illustrate, in some examples, the communications interface 826 includes a radio interface configured to communicate with the one or more devices 880 using a radio network that includes the system 500.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate, but do not limit, the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. A lens comprising:

a first hemispherical refractive structure having a first effective refractive index based on a first fill pattern of the first hemispherical refractive structure; and a second hemispherical refractive structure having a second effective refractive index based on a second fill pattern of the second hemispherical refractive structure, the second hemispherical refractive structure arranged as a hemispherical shell coupled to and concentric with the first hemispherical refractive structure, wherein the second effective refractive index is different than the first effective refractive index.

2. The lens of claim 1, wherein the first hemispherical refractive structure includes a first plurality of plate structures, and wherein the second hemispherical refractive structure includes a second plurality of plate structures.

3. The lens of claim 2, wherein the first effective refractive index is based on a first number of plate structures of the first plurality of plate structures, and wherein the second effective refractive index is based on a second number of plate structures of the second plurality of plate structures, the second number different than the first number.

4. The lens of claim 2, wherein the first effective refractive index is based on a first spacing between plate structures of the first plurality of plate structures, and wherein the second effective refractive index is based on a second spacing between plate structures of the second plurality of plate structures, the second spacing different than the first spacing.

5. The lens of claim 1, wherein the first fill pattern includes one of a linear fill pattern, a triangular fill pattern, a diagonal fill pattern, or a hexagonal fill pattern, and wherein the second fill pattern includes another of the linear fill pattern, the triangular fill pattern, the diagonal fill pattern, or the hexagonal fill pattern.

6. The lens of claim 1, wherein the first hemispherical refractive structure has a first fill density, and wherein the second hemispherical refractive structure has a second fill density different than the first fill density.

7. The lens of claim 1, wherein the first effective refractive index and the second effective refractive index define a gradient refractive index of a Luneburg lens.

8. The lens of claim 1, wherein the first effective refractive index and the second effective refractive index define a gradient refractive index of a fisheye lens.

9. A method of fabricating a lens, the method comprising:

forming a first hemispherical refractive structure of a lens, the first hemispherical refractive structure having a first effective refractive index based on a first fill pattern of the first hemispherical refractive structure; and forming a second hemispherical refractive structure of the lens as a hemispherical shell that is coupled to and concentric with the first hemispherical refractive structure, the second hemispherical refractive structure having a second effective refractive index based on a second fill pattern of the second hemispherical refractive structure, wherein the second effective refractive index is different than the first effective refractive index.

10. The method of claim 9, wherein the first hemispherical refractive structure and the second hemispherical refractive structure are formed using an additive manufacturing process.

11. The method of claim 9, wherein forming the first hemispherical refractive structure includes forming a first plurality of plate structures dimensioned to provide the first effective refractive index, and wherein forming the second hemispherical refractive structure includes forming on the first hemispherical refractive structure a second plurality of plate structures dimensioned to provide the second effective refractive index.

12. The method of claim 9, wherein forming the first hemispherical refractive structure includes forming a first plurality of plate structures having a first spacing to provide the first effective refractive index, and wherein forming the second hemispherical refractive structure includes forming on the first hemispherical refractive structure a second plurality of plate structures having a second spacing to provide the second effective refractive index.

13. The method of claim 9, wherein forming the first hemispherical refractive structure includes forming a first plurality of plate structures having the first fill pattern to provide the first effective refractive index, and wherein forming the second hemispherical refractive structure includes forming on the first hemispherical refractive structure a second plurality of plate structures having the second fill pattern to provide the second effective refractive index.

14. The method of claim 9, wherein the first fill pattern includes one of a linear fill pattern, a triangular fill pattern, a diagonal fill pattern, or a hexagonal fill pattern, and wherein the second fill pattern includes another of the linear fill pattern, the triangular fill pattern, the diagonal fill pattern, or the hexagonal fill pattern.

15. The method of claim 9, wherein forming the first hemispherical refractive structure includes forming a first plurality of plate structures having a first fill density to provide the first effective refractive index, and wherein forming the second hemispherical refractive structure includes forming on the first hemispherical refractive structure a second plurality of plate structures having a second fill density to provide the second effective refractive index.

16. A method of focusing a signal using a lens, the method comprising:

receiving a first signal at a lens; and focusing the first signal to generate a second signal using a first hemispherical refractive structure of the lens and using a second hemispherical refractive structure of the lens, the first hemispherical refractive structure having a first effective refractive index based on a first fill pattern of the first hemispherical refractive structure, the second hemispherical refractive structure arranged as a hemispherical shell coupled to and concentric with the first hemispherical refractive structure, the second hemispherical refractive structure having a second effective refractive index based on a second fill pattern of the second hemispherical refractive structure, wherein the second effective refractive index is different than the first effective refractive index.

17. The method of claim 16, wherein the lens corresponds to a Luneburg lens.

18. The method of claim 16, wherein the lens corresponds to a fisheye lens.

19. The method of claim 16, further comprising outputting the second signal to a waveguide.

20. The method of claim 16, further comprising outputting the second signal to a radio antenna.

* * * * *